US010633617B2

(12) United States Patent
Miracle et al.

(10) Patent No.: US 10,633,617 B2
(45) Date of Patent: Apr. 28, 2020

(54) DETERGENT COMPOSITIONS

(71) Applicant: The Procter & Gamble Company, Cincinnati, OH (US)

(72) Inventors: Gregory Scot Miracle, Liberty Township, OH (US); Eva Jean Tulchinsky, Cincinnati, OH (US); Daniel Dale Ditullio, Jr., Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 116 days.

(21) Appl. No.: 14/694,096

(22) Filed: Apr. 23, 2015

(65) Prior Publication Data

US 2016/0312158 A1 Oct. 27, 2016

(51) Int. Cl.

| | |
|---|---|
| ***C11D 3/40*** | (2006.01) |
| ***C11D 3/42*** | (2006.01) |
| ***C11D 3/34*** | (2006.01) |
| ***C11D 17/04*** | (2006.01) |

(52) U.S. Cl.

CPC ..... *C11D 3/40* (2013.01); *C11D 3/349* (2013.01); *C11D 17/042* (2013.01); *C11D 17/043* (2013.01); *C11D 3/3481* (2013.01)

(58) Field of Classification Search

None

See application file for complete search history.

(56) References Cited

U.S. PATENT DOCUMENTS

| | | | | |
|---|---|---|---|---|
| 7,964,549 | B2 | 6/2011 | Boutoille et al. | |
| 2002/0013243 | A1* | 1/2002 | Hewitt | C11D 17/0004 510/293 |
| 2003/0060387 | A1 | 3/2003 | Hsu et al. | |
| 2009/0249558 | A1* | 10/2009 | Fileccia | C11D 11/0017 8/137 |
| 2010/0294153 | A1* | 11/2010 | Content | B41M 1/04 101/483 |
| 2012/0101018 | A1* | 4/2012 | Miracle | C09B 31/072 510/324 |
| 2014/0162929 | A1 | 6/2014 | Labeque et al. | |

FOREIGN PATENT DOCUMENTS

| | | | |
|---|---|---|---|
| EP | 2 133 410 | A1 | 12/2009 |
| EP | 2133410 | A1 * | 12/2009 |
| WO | WO 03/031264 | A1 | 4/2003 |
| WO | WO 2009/047124 | A1 | 4/2009 |
| WO | WO 2009/052456 | A1 | 4/2009 |

OTHER PUBLICATIONS

International Search Report; International Application No. PCT/US2016/028257; dated Jun. 27, 2016; 13 pages.

* cited by examiner

*Primary Examiner* — Lorna M Douyon

(74) *Attorney, Agent, or Firm* — John T. Dipre

(57) ABSTRACT

Detergent compositions comprising a water-soluble film and a shading dye. At least about 10% of the shading dye is incorporated into the water-soluble film. Methods of making such detergent compositions.

8 Claims, 1 Drawing Sheet

DETERGENT COMPOSITIONS

FIELD OF THE INVENTION

The present disclosure relates in part to a detergent composition comprising a water-soluble or water-dispersible film and a shading dye. The invention also relates to a process for making such a detergent composition.

BACKGROUND OF THE INVENTION

Detergents today are available in a wide variety of forms such as powders, granules, liquids and gels. Unit dose and concentrated (or compact) detergent forms are becoming increasingly popular due to the convenience they offer the consumer on lower weight and, in the case of unit dose, simplified dosing. The highly concentrated nature of these forms offers further sustainability advantages, such as reduced shipping costs and environmental impact (e.g. carbon footprint).

Further, as textile substrates age, their color tends to fade or yellow due to exposure to light, air, soil, and natural degradation of the fibers that comprise the substrates. Thus, the purpose of shading dyes is generally to visually whiten these textile substrates and counteract the fading and yellowing of the substrates. Typically, shading dyes may be found in laundry detergents and are therefore applied to textile substrates during the laundering process. However, the color of the shading dyes typically dominates the overall appearance of the composition in which it resides. Further, it is also known that shading dyes interact negatively with certain adjunct material in the composition in which it resides.

As a result, there exists a need for a detergent composition that includes both a water-soluble film and a shading dye, but also provides flexibility in the composition's appearance and components.

It has surprisingly been found that the detergent compositions of the present disclosure which incorporate the shading dyes in the water-soluble film are not only effective in cleaning and whitening of textile substrates, but also provide flexibility in the composition's appearance and components.

SUMMARY OF THE INVENTION

The present disclosure relates to a detergent composition comprising a first composition, a water-soluble film, and a shading dye. The first composition is selected from the group consisting of a liquid detergent, a granular detergent, or a tablet detergent, and at least about 10% of the shading dye is incorporated into the water-soluble film.

The present disclosure also relates to a method of making a detergent composition comprising a first composition, a water-soluble film and a shading dye. The method comprises the steps of incorporating the shading dye into the film and encapsulating the first composition in the water-soluble film.

The present disclosure also relates to a unit dose detergent composition comprising at least one compartment, a water-soluble film, and a shading dye. At least about 10% of the shading dye is incorporated into the water-soluble film.

DETAILED DESCRIPTION OF THE INVENTION

Figure 1:
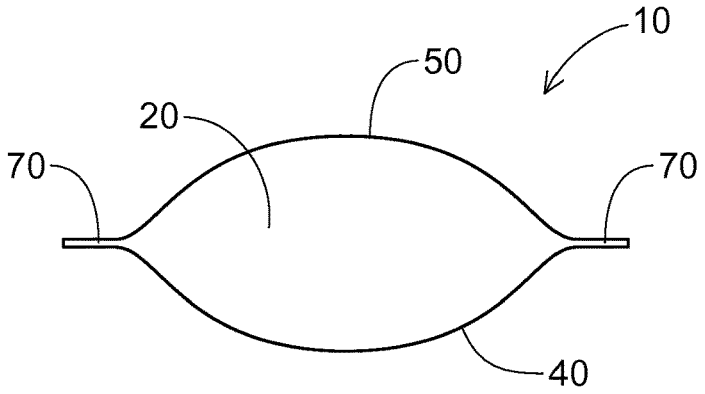
FIG. 1 is a side view of a unit dose article according to the present invention.
Figure 2:
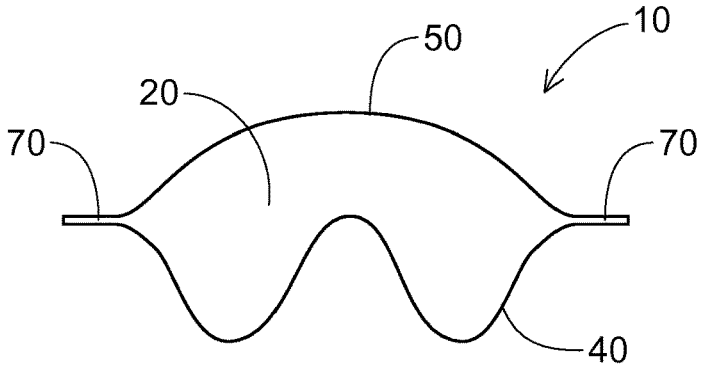
FIG. 2 is a side view of another embodiment of unit dose article according to the present invention.

The present disclosure relates to detergent compositions that comprise a water-soluble film and a shading dye.

Definitions

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting. The phases "comprising" or "comprises" are intended to include the more limiting phrases "consisting essentially of" and "consisting of." Therefore, a composition that comprises a component may consist essentially of that component, or consist of that component.

As used herein, the terms "substantially free of" or "substantially free from" mean that the indicated material is at the very minimum not deliberately added to the composition to form part of it, or, preferably, is not present at analytically detectable levels. It is meant to include compositions whereby the indicated material is present only as an impurity in one of the other materials deliberately included.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

In this description, all concentrations and ratios are on a weight basis of the composition unless otherwise specified.

Detergent Composition

As used herein, the phrase "detergent composition" includes compositions and formulations designed for cleaning soiled material. Such compositions include, but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, slurry, single-phase or multi-phase unit dose articles, pouch, tablet, gel, paste, bar, or flake.

In some aspects, the detergent composition comprises a first composition where the first composition is selected from the group consisting of a liquid detergent, a granular detergent, or a tablet detergent. Preferably, when the first composition is a granular detergent or a tablet detergent, the first composition is encased in either a water-soluble film or a water-soluble coating.

Liquid detergent compositions and other forms of detergent compositions that include a liquid component (such as liquid-containing unit dose detergent compositions) may contain water and other solvents as fillers or carriers. Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used. Amine-containing solvents may also be used. Solvents particularly useful in unit dose articles are described below.

The detergent compositions may contain from about 5% to about 90%, and in some examples, from about 10% to about 50%, by weight of the composition, of such carriers. For compact or super-compact heavy duty liquid or other forms of detergent compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

The liquid detergent compositions may comprise water. However, when the liquid composition will be in contact with water-soluble film, for example in a unit dose article, it is typically desirable to limit the amount of water so as to preserve the film's integrity and to prevent a tacky feel to the pouches. Therefore, in some embodiments, the liquid detergent composition comprises less than about 50% water by weight of the liquid composition, or less than about 40% water by weight of the liquid composition, or from about 1% to about 30%, or preferably from about 2% to about 20%, or from about 5% to about 13%, water by weight of the liquid composition.

For powder or bar detergent compositions, or forms that include a solid or powder component (such as powder-containing unit dose detergent composition), suitable fillers may include, but are not limited to, sodium sulfate, sodium chloride, clay, or other inert solid ingredients. Fillers may also include biomass or decolorized biomass. Fillers in granular, bar, or other solid detergent compositions may comprise less than about 80% by weight of the detergent composition, and in some examples, less than about 50% by weight of the detergent composition. Compact or supercompact powder or solid detergent compositions may comprise less than about 40% filler by weight of the detergent composition, or less than about 20%, or less than about 10%.

For either compacted or supercompacted liquid or powder detergent compositions, or other forms, the level of liquid or solid filler in the product may be reduced, such that either the same amount of active chemistry is delivered to the wash liquor as compared to noncompacted detergent compositions, or in some examples, the detergent composition is more efficient such that less active chemistry is delivered to the wash liquor as compared to noncompacted compositions. For example, the wash liquor may be formed by contacting the detergent composition to water in such an amount so that the concentration of detergent composition in the wash liquor is from above 0 g/l to 4 g/l. In some examples, the concentration may be from about 1 g/l to about 3.5 g/l, or to about 3.0 g/l, or to about 2.5 g/l, or to about 2.0 g/l, or to about 1.5 g/l, or from about 0 g/l to about 1.0 g/l, or from about 0 g/l to about 0.5 g/l. These dosages are not intended to be limiting, and other dosages may be used that will be apparent to those of ordinary skill in the art.

In some aspects, referring to the embodiments in FIGS. 1-4, the detergent composition is in the form of a unit dose article 10. The unit dose article 10 comprises at least one compartment, wherein the compartment comprises a composition, for example a first composition 20. A unit dose article 10 is intended to provide a single, easy to use dose of the composition contained within the article for a particular application. In some aspects, the detergent composition is in unit dose form 10 and comprises water-soluble film that encapsulates a liquid detergent.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film 40 may be shaped to comprise an open compartment into which the composition is added. A second film 50 is then laid over the first film 40 in such an orientation as to close the opening of the compartment. The first 40 and second 50 films are then sealed together along a seal region 70. The seal region 70 may comprise a flange. The flange is comprised of excess sealed film material that protrudes beyond the edge of the unit dose article and provides increased surface area for seal of the first 40 and second 50 films. The film is described in more detail below. In some aspects, the unit dose article 10 comprises three, four, five or more films.

Figure 3:
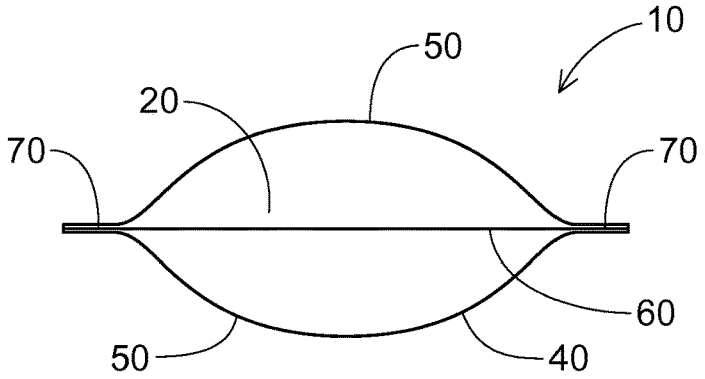
FIG. 3 is a side view of another embodiment of unit dose article according to the present invention.
Figure 4:
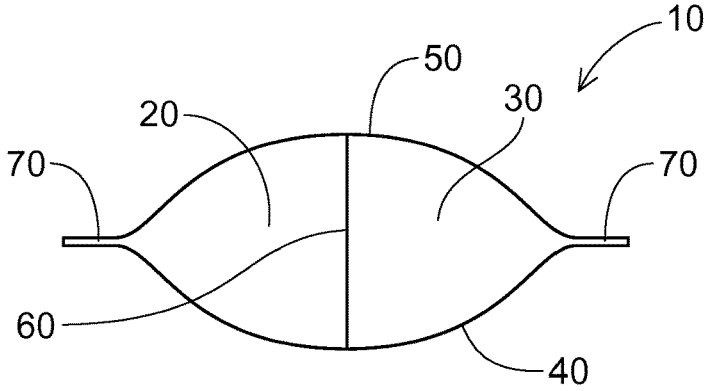
FIG. 4 is a side view of another embodiment of unit dose article according to the present invention.

The unit dose article 10 may comprise more than one compartment, even at least two compartments, or even at least three compartments. In some aspects, the unit dose article 10 comprises 1, or 2, or 3, or 4, or 5 compartments. The compartments may be arranged in superposed orientation, i.e., one positioned on top of the other, as shown in FIG. 3, where they may share a common wall 60. In one aspect, at least one compartment is superposed on another compartment. Alternatively, the compartments may be positioned in a side-by-side orientation, i.e., one orientated next to the other, as shown in FIG. 4. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

When the unit dose article comprises at least two compartments, one of the compartments may be smaller than the other compartment. When the unit dose article comprises at least three compartments, two of the compartments may be smaller than the third compartment, and preferably the smaller compartments are superposed on the larger compartment. The smaller superposed compartments preferably are orientated side-by-side.

When the unit dose article comprises at least two compartments, each compartment may comprise identical compositions, or each compartment may independently comprise a different composition. The compartments may be sensorially different; for example, the compartments may have different shapes, or they may be different colors.

The encapsulated compositions may be any suitable composition. The composition may be in the form of a solid, a liquid, a dispersion, a gel, a paste, or a mixture thereof. The compositions in each compartment of a multicompartment unit dose article may be different. However, typically at least one compartment of the unit dose article, preferably each compartment, comprises a liquid. The composition is described in more detail below.

Water-Soluble or Water-Dispersible Film

In some aspects, the detergent composition of the present disclosure comprises water-soluble or water-dispersible film. The film may encapsulate the detergent composition, preferably the first composition. The film may encapsulate a liquid composition, a granular detergent, a tablet detergent, or mixtures thereof.

The film of the present invention is soluble or dispersible in water. The water-soluble film preferably has a thickness of from about 20 to about 150 microns, preferably about 35 to about 125 microns, even more preferably about 50 to about 110 microns, most preferably about 76 microns.

Preferably, the film has a water-solubility of at least 50%, preferably at least 75% or even at least 95%, as measured by the method set out here after using a glass-filter with a maximum pore size of 20 microns:

50 grams±0.1 gram of film material is added in a preweighed 400 ml beaker and 245 ml±1 ml of distilled water is added. This is stirred vigorously on a magnetic stirrer, Lab-Line model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-molding, extrusion, or blown extrusion of the polymeric material, as known in the art. Preferably the film is obtained by an extrusion process or by a casting process.

Preferred polymers (including copolymers, terpolymers, or derivatives thereof) suitable for use as film material are selected from polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More-preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the polymers of the film material are free of carboxylate groups.

Preferably, the level of polymer in the film material, for example a PVA polymer, is at least 60%. The polymer can have any weight average molecular weight, preferably from about 1000 to 1,000,000, more preferably from about 10,000 to 300,000, yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000 to about 40,000, preferably about 20,000, and of PVA or copolymer thereof, with a weight average molecular weight of about 100,000 to about 300,000, preferably about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers, preferably polyvinyl alcohol, have a degree of hydrolysis of from about 60% to about 99%, preferably from about 80% to about 99%, even more preferably from about 80% to about 90%, to improve the dissolution characteristics of the material. As used herein, the degree of hydrolysis is expressed as a percentage of vinyl acetate units converted to vinyl alcohol units.

Preferred films exhibit good dissolution in cold water, meaning unheated distilled water. Preferably such films exhibit good dissolution at temperatures 24° C., even more preferably at 10° C. By good dissolution it is meant that the film exhibits water-solubility of at least 50%, preferably at least 75% or even at least 95%, as measured, by the method set out herein using a glass-filter with a maximum pore size of 20 microns, described above. Water-solubility may be determined at 24° C., or preferably at 10° C.

Preferred films are those supplied by Monosol (Merrillville, Ind., USA) under the trade references M8630, M8900, M8779, and M8310 films described in U.S. Pat. Nos. 6,166,117 and 6,787,512, and PVA films of corresponding solubility and deformability characteristics. Other suitable films may include called Solublon® PT, Solublon® GA, Solublon® KC or Solublon® KL from the Aicello Chemical Europe GmbH, the films VF-HP by Kuraray, or the films by Nippon Gohsei, such as Hi Selon. Further preferred films are those described in US2006/0213801, US2011/0188784, WO2010/119022, and U.S. Pat. No. 6,787,512. In some aspects, it is preferable to use a film that exhibits better dissolution than M8630 film, supplied by Monosol, at temperatures 24° C., even more preferably at 10° C.

Preferred water soluble films are those derived from a resin that comprises a blend of polymers, preferably wherein at least one polymer in the blend is polyvinyl alcohol. Preferably, the water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 centipoise (cP), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2: 2006 Annex E Brookfield Test method. It is international practice to state the viscosity of 4% aqueous polyvinyl alcohol solutions at 20° C. All viscosities specified herein in cP should be understood to refer to the viscosity of 4% aqueous polyvinyl alcohol solution at 20° C., unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a molecular weight in a range of about 50,000 to about 300,000 Daltons, or about 60,000 to about 150,000 Daltons; and a second PVA polymer that has a molecular weight in a range of about 60,000 to about 300,000 Daltons, or about 80,000 to about 250,000 Daltons.

Different film material and/or films of different thickness may be employed in making the compartments of the present invention. A benefit in selecting different films is that the resulting compartments may exhibit different solubility or release characteristics.

The film material herein can also comprise one or more additive ingredients. For example, the film preferably comprises a plasticizing agent. The plasticizing agent may comprise water, glycerol, ethylene glycol, diethylene glycol, propylene glycol, sorbitol, or mixtures thereof. In some aspects, the film comprises from about 2% to about 35%, or from about 5% to about 25%, by weight of the film, a plasticizing agent selected from group comprising water, glycerol, diethylene glycol, sorbitol, and mixtures thereof. In some aspects, the film material comprises at least two, or preferably at least three, plasticizing agents. In some aspects, the film is substantially free of ethanol, meaning that the film comprises from 0% (including 0%) to about 0.1% ethanol by weight of the film. In some aspects, the plasticizing agents are the same as the plasticizing solvents in the liquid composition, described below.

Other additives may include water and functional detergent additives, including surfactant, to be delivered to the wash water, for example, organic polymeric dispersants, etc.

Shading Dye

The detergent composition comprises a shading dye. Preferably, at least about 10%, 30%, 50%, 70%, 90%, or even about 95% of the shading dye is incorporated into the water-soluble film. In one preferred embodiment, substantially all of the shading dye is incorporated into water-soluble film. It will be understood that the shading dye can be incorporated into any part of the film(s), as discussed above. For example, in one embodiment, the shading dye is incorporated into one of or both of the first film and/or the second film. In yet another embodiment, the shading dye is incorporated into the common wall and, in one particularly preferred embodiment substantially all of the shading dye is incorporated into the common wall.

The shading dye (sometimes referred to as hueing, bluing or whitening agents) typically provides a blue or violet shade to fabric. Shading dyes can be used either alone or in combination to create a specific shade of hueing and/or to shade different fabric types. This may be provided for example by mixing a red and green-blue dye to yield a blue or violet shade. Preferably the hueing dye is a blue or violet hueing dye, providing a blue or violet color to a white cloth or fabric. Such a white cloth treated with the composition will have a hue angle of 240 to 345, more preferably 260 to 325, even more preferably 270 to 310.

In one aspect, a hueing dye suitable for use in the present invention has, in the wavelength range of about 400 nm to about 750 nm, in methanol solution, a maximum extinction coefficient greater than about 1000 liter/mol/cm. In one aspect, a hueing dye suitable for use in the present invention has, in the wavelength range of about 540 nm to about 630 nm, a maximum extinction coefficient from about 10,000 to about 100,000 liter/mol/cm. In one aspect, a hueing dye suitable for use in the present invention has, in the wavelength range of about 560 nm to about 610 nm, a maximum extinction coefficient from about 20,000 to about 70,000 liter/mol/cm or even about 90,000 liter/mol/cm.

The Test Methods provided below can be used to determine if a dye, or a mixture of dyes, is a shading dye for the purposes of the present invention.

Test Methods

I. Method for Determining Deposition for a Dye a.) Unbrightened Multifiber Fabric Style 41 swatches (MFF41, 5 cm×10 cm, average weight 1.46 g) serged with unbrightened thread are purchased from Testfabrics, Inc. (West Pittston, Pa.). MFF41 swatches are stripped prior to use by washing two full cycles in AATCC heavy duty liquid laundry detergent (HDL) nil brightener at 49° C. and washing 3 additional full cycles at 49° C. without detergent. Four replicate swatches are placed into each flask.

b.) A sufficient volume of AATCC standard nil brightener HDL detergent solution is prepared by dissolving the detergent in 0 gpg water at room temperature at a concentration of 1.55 g per liter.

c.) A concentrated stock solution of dye is prepared in an appropriate solvent selected from dimethyl sulfoxide (DMSO), ethanol or 50:50 ethanol:water. Ethanol is preferred. The dye stock is added to a beaker containing 400 mL detergent solution (prepared in step I.b. above) in an amount sufficient to produce an aqueous solution absorbance at the $\lambda_{max}$ of 0.1 AU (±0.01 AU) in a cuvette of path length 1.0 cm. For a mixture of dyes, the sum of the aqueous solution absorbance at the $\lambda_{max}$ of the individual dyes is 0.1 AU (±0.01 AU) in a cuvette of path length 1.0 cm. Total organic solvent concentration in a wash solution from the concentrated stock solution is less than 0.5%. A 125 mL aliquot of the wash solution is placed into 3 separate disposable 250 mL Erlenmeyer flasks (Thermo Fisher Scientific, Rochester, N.Y.).

d.) Four MFF41 swatches are placed into each flask, flasks are capped and manually shaken to wet the swatches. Flasks are placed onto a Model 75 wrist action shaker from Burrell Scientific, Inc. (Pittsburgh, Pa.) and agitated on the highest setting of 10 (390 oscillations per minute with an arc of 14.6°). After 12 minutes, the wash solution is removed by vacuum aspiration, 125 mL of 0 gpg water is added for a rinse, and the flasks agitated for 4 additional minutes. Rinse solution is removed by vacuum aspiration and swatches are spun in a Mini Countertop Spin Dryer (The Laundry Alternative Inc., Nashua, N.H.) for 5 minutes, after which they are allowed to air dry in the dark.

e.) L*, a*, and b* values for the 3 most consumer relevant fabric types, cotton and polyester, are measured on the dry swatches using a LabScan XE reflectance spectrophotometer (HunterLabs, Reston, Va.; D65 illumination, 10° observer, UV light excluded). The L*, a*, and b* values of the 12 swatches (3 flasks each containing 4 swatches) are averaged and the hueing deposition (HD) of the dye is calculated for each fabric type using the following equation:

$$HD=DE^*=((L^*_c-L^*_s)^2+(a^*_c-a^*_s)^2+(b^*_c-b^*_s)^2)^{1/2}$$

wherein the subscripts c and s respectively refer to the control, i.e., the fabric washed in detergent with no dye, and the fabric washed in detergent containing dye, or a mixture of dyes, according to the method described above.

II. Method for Determining Relative Hue Angle (vs. Nil Dye Control)

a) The a* and b* values of the 12 swatches from each solution were averaged and the following formulas used to determine Δa* and Δb*:

$$\Delta a^*=a^*_c-a^*_s \text{ and } \Delta b^*=b^*_c-b^*_s$$

wherein the subscripts c and s respectively refer to the fabric washed in detergent with no dye and the fabric washed in detergent containing dye, or mixture of dyes, according to the method described in I. above.

b.) If the absolute value of both Δa* and Δb*<0.25, no Relative Hue Angle (RHA) was calculated. If the absolute value of either Δa* or Δb* were ≥0.25, the RHA was determined using one of the following formulas:

$$\text{When } \Delta b^*\geq 0,\ RHA=A\ TAN\ 2(\Delta a^*,\Delta b^*)$$

$$\text{When } \Delta b^*<0,\ RHA=360+A\ TAN\ 2(\Delta a^*,\Delta b^*)$$

III. Method to Determine if a Dye is a Shading Dye

A dye, or mixture of dyes, is considered a shading dye (also known as a hueing dye) for the purposes of the present invention if (a) either the $HD_{cotton}$ or the $HD_{polyester}$ is greater than or equal to 2.0 DE* units or preferably greater than or equal to 3.0, or 4.0 or even 5.0, according to the formula above, and (b) the relative hue angle (see Method III. below) on the fabric that meets the DE* criterion in (a) is within 240 to 345, more preferably 260 to 325, even more preferably 270 to 310. If the value of HD for both fabric types is less than 2.0 DE* units, or if the relative hue angle is not within the prescribed range on each fabric for which the DE* meets the criteria the dye is not a shading dye for the purposes of the present invention.

The shading dye may be selected from any chemical class of dye as known in the art, including but not limited to acridine, anthraquinone (including polycyclic quinones), azine, azo (e.g., monoazo, disazo, trisazo, tetrakisazo, polyazo), benzodifurane, benzodifuranone, carotenoid, coumarin, cyanine, diazahemicyanine, diphenylmethane, formazan, hemicyanine, indigoids, methane, naphthalimides, naphthoquinone, nitro, nitroso, oxazine, phthalocyanine, pyrazoles, stilbene, styryl, triarylmethane, triphenylmethane, xanthenes and mixtures thereof.

Suitable shading dyes include small molecule dyes, polymeric dyes and dye-clay conjugates. Preferred shading dyes are selected from small molecule dyes and polymeric dyes.

Small Molecule Dyes

Suitable small molecule dyes may be selected from the group consisting of dyes falling into the Colour Index (C.I., Society of Dyers and Colourists, Bradford, UK) classifications of Acid, Direct, Basic, Reactive, Solvent or Disperse dyes. Preferably such dyes can be classified as Blue, Violet, Red, Green or Black, and provide the desired shade either alone or in combination with other dyes or in combination with other adjunct ingredients. Reactive dyes may contain small amounts of hydrolyzed dye as sourced, and in detergent formulations or in the wash may undergo additional hydrolysis. Such hydrolyzed dyes and mixtures may also serve as suitable small molecule dyes.

In another aspect, suitable dyes include those selected from the group consisting of dyes denoted by the Colour Index designations such as Direct Violet 5, 7, 9, 11, 31, 35, 48, 51, 66, and 99, Direct Blue 1, 71, 80 and 279, Acid Red 17, 73, 52, 88 and 150, Acid Violet 15, 17, 24, 43, 49 and 50, Acid Blue 15, 17, 25, 29, 40, 45, 48, 75, 80, 83, 90 and 113, Acid Black 1, Basic Violet 1, 3, 4, 10 and 35, Basic Blue 3, 16, 22, 47, 66, 75 and 159, anthraquinone Disperse or Solvent dyes such as Solvent Violet 11, 13, 14, 15, 15, 26, 28, 29, 30, 31, 32, 33, 34, 26, 37, 38, 40, 41, 42, 45, 48, 59; Solvent Blue 11, 12, 13, 14, 15, 17, 18, 19, 20, 21, 22, 35, 36, 40, 41, 45, 59, 59:1, 63, 65, 68, 69, 78, 90; Disperse Violet 1, 4, 8, 11, 11:1, 14, 15, 17, 22, 26, 27, 28, 29, 34, 35, 36, 38, 41, 44, 46, 47, 51, 56, 57, 59, 60, 61, 62, 64, 65, 67, 68, 70, 71, 72, 78, 79, 81, 83, 84, 85, 87, 89, 105; Disperse Blue 2, 3, 3:2, 8, 9, 13, 13:1, 14, 16, 17, 18, 19, 22, 23, 24, 26, 27, 28, 31, 32, 34, 35, 40, 45, 52, 53, 54, 55, 56, 60, 61, 62, 64, 65, 68, 70, 72, 73, 76, 77, 80, 81, 83, 84, 86, 87, 89, 91, 93, 95, 97, 98, 103, 104, 105, 107, 108, 109, 11, 112, 113, 114, 115, 116, 117, 118, 119, 123, 126, 127, 131, 132, 134, 136, 140, 141, 144, 145, 147, 150, 151, 152, 153, 154, 155, 156, 158, 159, 160, 161, 162, 163, 164, 166, 167, 168, 169, 170, 176, 179, 180, 180:1, 181, 182, 184, 185, 190, 191, 192, 196, 197, 198, 199, 203, 204, 213, 214, 215, 216, 217, 218, 223, 226, 227, 228, 229, 230, 231, 232, 234, 235, 236, 237, 238, 239, 240, 241, 242, 243, 244, 245, 246, 247, 249, 252, 261, 262, 263, 271, 272, 273, 274, 275, 276, 277, 289, 282, 288, 289, 292, 293, 296, 297, 298, 299, 300, 302, 306, 307, 308, 309, 310, 311, 312, 314, 318, 320, 323, 325, 326, 327, 331, 332, 334, 347, 350, 359, 361, 363, 372, 377 and 379, azo Disperse dyes such as Disperse Blue 10, 11, 12, 21, 30, 33, 36, 38, 42, 43, 44, 47, 79, 79:1, 79:2, 79:3, 82, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 206, 207, 209, 210, 211, 212, 219, 220, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 304, 313, 315, 316, 317:319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 3, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 104, 106 and 107. Preferably, small molecule dyes can be selected from the group consisting of C. I. numbers Acid Violet 17, Acid Blue 80, Acid Violet 50, Direct Blue 71, Direct Violet 51, Direct Blue 1, Acid Red 88, Acid Red 150, Acid Blue 29, Acid Blue 113 or mixtures thereof.

In another aspect suitable small molecule dyes include dyes with CAS-No's 52583-54-7, 42783-06-2, 210758-04-6, 104366-25-8, 122063-39-2, 167940-11-6, 52239-04-0, 105076-77-5, 84425-43-4, and 87606-56-2, and non-azo dyes Disperse Blue 250, 354, 364, Solvent Violet 8, Solvent blue 43, 57, Lumogen F Blau 650, and Lumogen F Violet 570.

In another aspect suitable small molecule dyes include azo dyes, preferably mono-azo dyes, covalently bound to phthalocyanine moieties, preferably Al- and Si-phthalocyanine moieties, via an organic linking moiety.

Polymeric Dyes

Suitable polymeric dyes include dyes selected from the group consisting of polymers containing covalently bound (sometimes referred to as conjugated) chromogens, (also known as dye-polymer conjugates), for example polymers with chromogen monomers co-polymerized into the backbone of the polymer and mixtures thereof.

Polymeric dyes include: (a) Reactive dyes bound to water soluble polyester polymers via at least one and preferably two free OH groups on the water soluble polyester polymer. The water soluble polyester polymers can be comprised of comonomers of a phenyl dicarboxylate, an oxyalkyleneoxy and a polyoxyalkyleneoxy; (b) Reactive dyes bound to polyamines which are polyalkylamines that are generally linear or branched. The amines in the polymer may be primary, secondary and/or tertiary. Polyethyleneimine in one aspect is preferred. In another aspect, the polyamines are ethoxylated; (c) Dye polymers having dye moieties carrying negatively charged groups obtainable by copolymerization of an alkene bound to a dye containing an anionic group and one or more further alkene comonomers not bound to a dye moiety; (d) Dye polymers having dye moieties carrying positively charged groups obtainable by copolymerization of an alkene bound to a dye containing an cationic group and one or more further alkene comonomers not bound to a dye moiety; (e) Polymeric thiophene azo polyoxyalkylene dyes containing carboxylate groups; and (f) dye polymer conjugates comprising at least one reactive dye and a polymer comprising a moiety selected from the group consisting of a hydroxyl moiety, a primary amine moiety, a secondary amine moiety, a thiol moiety and combinations thereof; said polymers preferably selected from the group consisting of polysaccharides, proteins, polyalkyleneimines, polyamides, polyols, and silicones. In one aspect, carboxymethyl cellulose (CMC) may be covalently bound to one or more reactive blue, reactive violet or reactive red dye such as CMC conjugated with C.I. Reactive Blue 19, sold by Megazyme, Wicklow, Ireland under the product name AZO-CM-CELLULOSE, product code S-ACMC.

Other suitable polymeric dyes include polymeric dyes selected from the group consisting of alkoxylated triphenylmethane polymeric colourants, alkoxylated carbocyclic and alkoxylated heterocyclic azo colourants, including alkoxylated thiophene polymeric colourants, and mixtures thereof. Preferred polymeric dyes comprise the optionally substituted alkoxylated dyes, such as alkoxylated triphenyl-methane polymeric colourants, alkoxylated carbocyclic and alkoxylated heterocyclic azo colourants including alkoxylated thiophene polymeric colourants, and mixtures thereof, such as the fabric-substantive colorants sold under the name of Liquitint® (Milliken, Spartanburg, S.C., USA).

Suitable polymeric dyes are illustrated below. As with all such alkoxylated compounds, the organic synthesis may produce a mixture of molecules having different degrees of alkoxylation. During a typical ethoxylation process, for example, the randomness of the ethylene oxide addition results in a mixture of oligomers with different degrees of ethoxylation. As a consequence of its ethylene oxide number distribution, which often follows a Poisson law, a commercial material contains substances with somewhat different properties. For example, in one aspect, the polymeric dye resulting from an ethoxylation is not a single compound containing five ($CH_2CH_2O$) units as the general structure (Formula A, with x+y=5) may suggest. Instead, the product is a mixture of several homologs whose total of ethylene oxide units varies from about 2 to about 10. Industrially relevant processes will typically result in such mixtures, which may normally be used directly to provide the shading dye, or less commonly may undergo a purification step.

Preferably, the shading dye may wherein the shading dye has the following structure:

Dye-(G)a-$NR^1R^2$, wherein the -(G)a-$NR^1R^2$ group is attached to an aromatic ring of the dye, G is independently —$SO_2$— or —C(O)—, the index a is an integer with a value of 0 or 1 and $R^1$ and $R^2$ are independently selected from H, a polyoxyalkylene chain, a $C_{1-8}$ alkyl, optionally the alkyl chains comprise ether (C—O—C), ester and/or amide links, optionally the alkyl chains are substituted with —Cl, —Br, —CN, —$NO_2$, —$SO_2CH_3$, —OH and mixtures thereof, $C_{6-10}$ aryl, optionally substituted with a polyoxyalkylene chain, $C_{7-16}$ alkaryl optionally substituted with ether (C—O—C), ester and/or amide links, optionally substituted with —Cl, —Br, —CN, —$NO_2$, —$SO_2CH_3$, —OH, polyoxyalkylene chain substituted $C_{1-8}$ alkyl, polyoxyalkylene chain substituted $C_{6-10}$ aryl, polyoxyalkylene chain substituted $C_{7-16}$ alkaryl and mixtures thereof; said polyoxyalkylene chains independently having from about 2 to about 100, about 2 to about 50, about 3 to about 30 or about 4 to about 20 repeating units. Preferably, the repeating units are selected from the group consisting of ethylene oxide, propylene oxide, butylene oxide and mixtures thereof. Preferably, the repeating units are essentially ethylene oxide.

Preferably, the shading dye may have the structure of Formula A:

Formula A

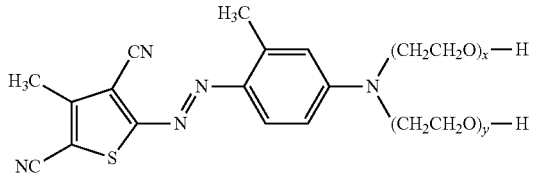

wherein the index values x and y are independently selected from 1 to 10. In some aspects, the average degree of ethoxylation, x+y, sometimes also referred to as the average number of ethoxylate groups, is from about 3 to about 12, preferably from about 4 to about 8. In some embodiments the average degree of ethoxylation, x+y, can be from about 5 to about 6. The range of ethoxylation present in the mixture varies depending on the average number of ethoxylates incorporated. Typical distributions for ethoxylation of toluidine with either 5 or 8 ethoxylates are shown in Table II on page 42 in the Journal of Chromatography A 1989, volume 462, pp. 39-47. The whitening agents are synthesized according to the procedures disclosed in U.S. Pat. No. 4,912,203 to Kluger et al.; a primary aromatic amine is reacted with an appropriate amount of ethylene oxide, according to procedures well known in the art. The polyethyleneoxy substituted m-toluidine useful in the preparation of the colorant can be prepared by a number of well known methods. It is preferred, however, that the polyethyleneoxy groups be introduced into the m-toluidine molecule by reaction of the m-toluidine with ethylene oxide. Generally the reaction proceeds in two steps, the first being the formation of the corresponding N,N-dihydroxyethyl substituted m-toluidine. In some aspects, no catalyst is utilized in this first step (for example as disclosed at Column 4, lines 16-25 of U.S. Pat. No. 3,927,044 to Foster et al.). The dihydroxyethyl substituted m-toluidine is then reacted with additional ethylene oxide in the presence of a catalyst such as sodium (described in Preparation II of U.S. Pat. No. 3,157,633 to Kuhn), or it may be reacted with additional ethylene oxide in the presence of sodium or potassium hydroxide (described in Example 5 of U.S. Pat. No. 5,071,440 to Hines et al.). The amount of ethylene oxide added to the reaction mixture determines the number of ethyleneoxy groups which ultimately attach to the nitrogen atom. In some aspects, an excess of the polyethyleneoxy substituted m-toluidine coupler may be employed in the formation of the whitening agent and remain as a component in the final colorant mixture. In certain aspects, the presence of excess coupler may confer advantageous properties to a mixture in which it is incorporated such as the raw material, a pre-mix, a finished product or even the wash solution prepared from the finished product.

The shading dye may preferably have the following structure:

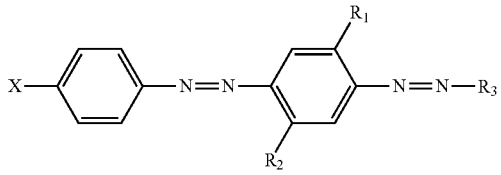

wherein:

$R_1$ and $R_2$ are independently selected from the group consisting of: H; alkyl; alkoxy; alkyleneoxy; alkyl capped alkyleneoxy; urea; and amido;

$R_3$ is a substituted aryl group;

X is a substituted group comprising sulfonamide moiety and optionally an alkyl and/or aryl moiety, and wherein the substituent group comprises at least one alkyleneoxy chain.

The hueing dye may be a thiophene dye such as a thiophene azo dye, preferably alkoxylated. Optionally the dye may be substituted with at least one solubilising group selected from sulphonic, carboxylic or quaternary ammonium groups.

Non-limiting examples of suitable shading dyes are:

Dye Formula 1

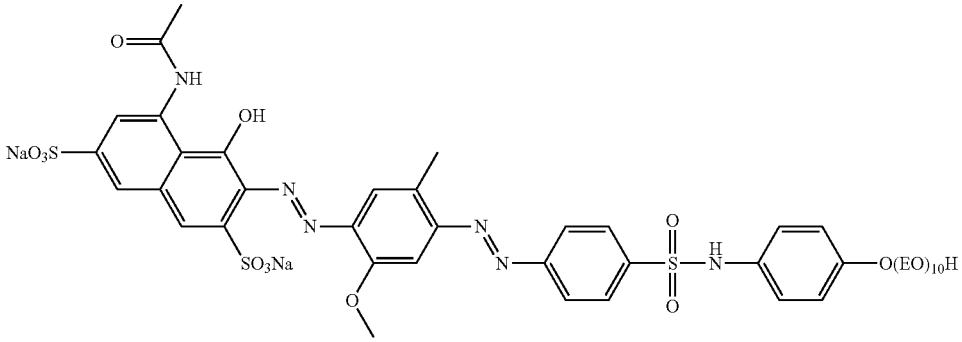

Dye Formula 2

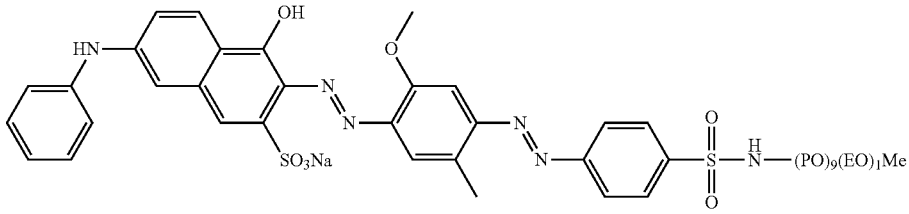

Dye Formula 3

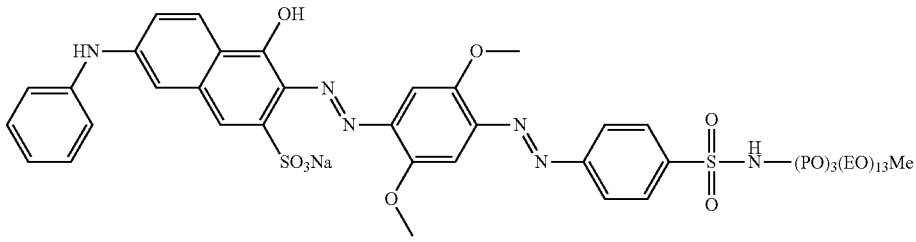

Dye Formula 4

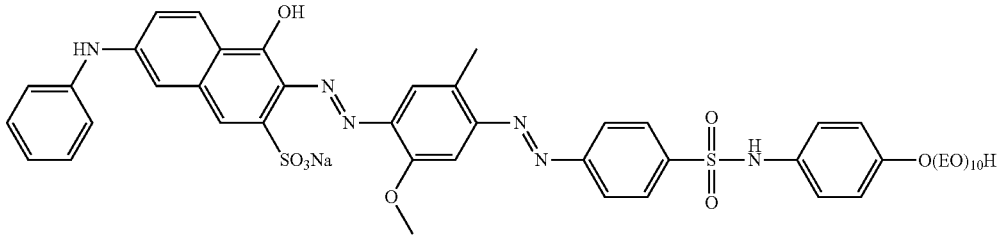

-continued
Dye Formula 5
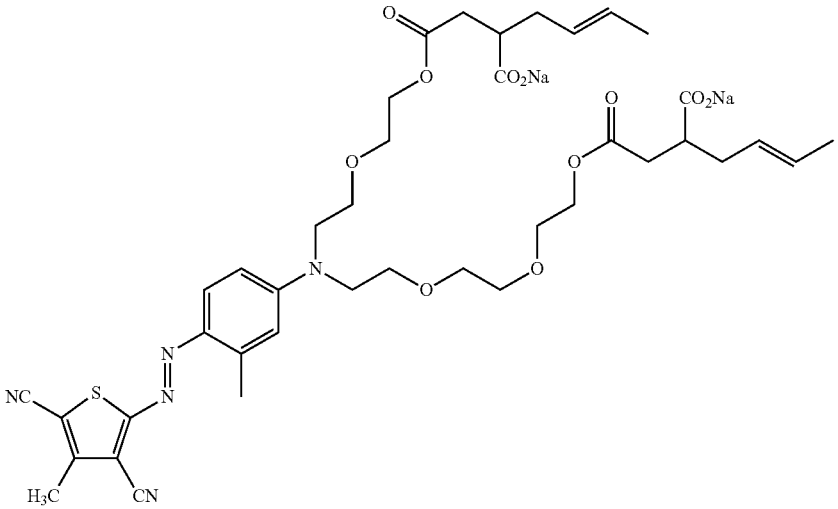
Dye Formula 6
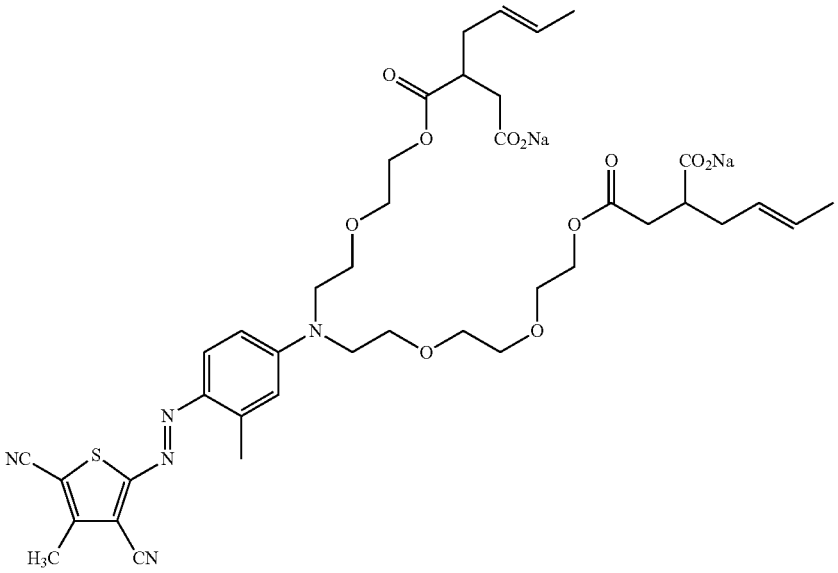
Dye Formula 7
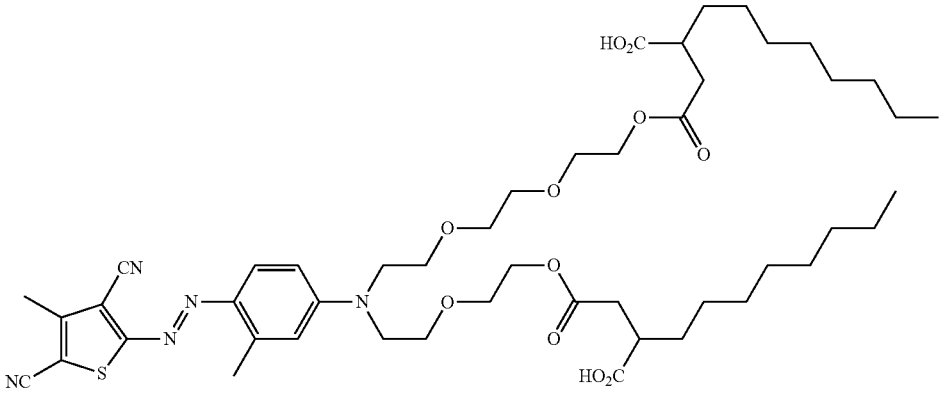

-continued

Dye Formula 8

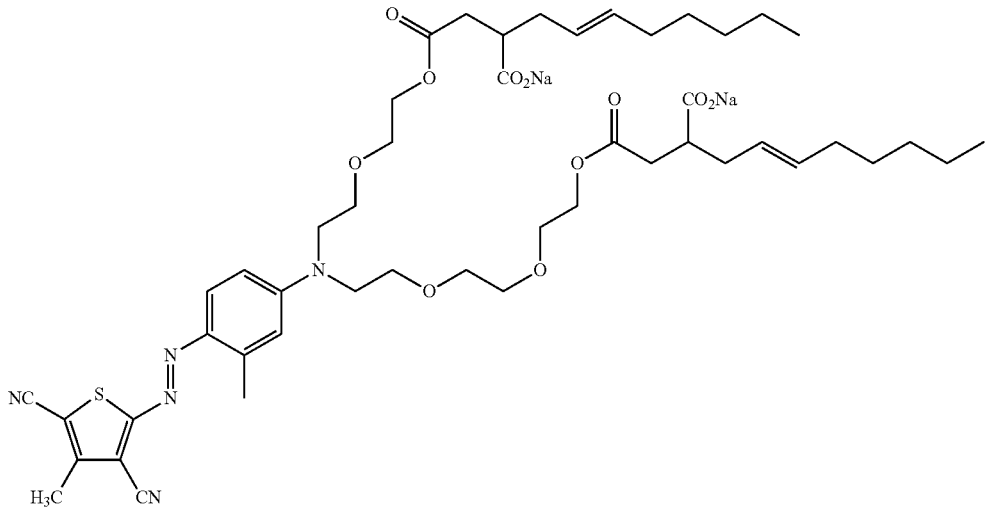

Dye Formula 9

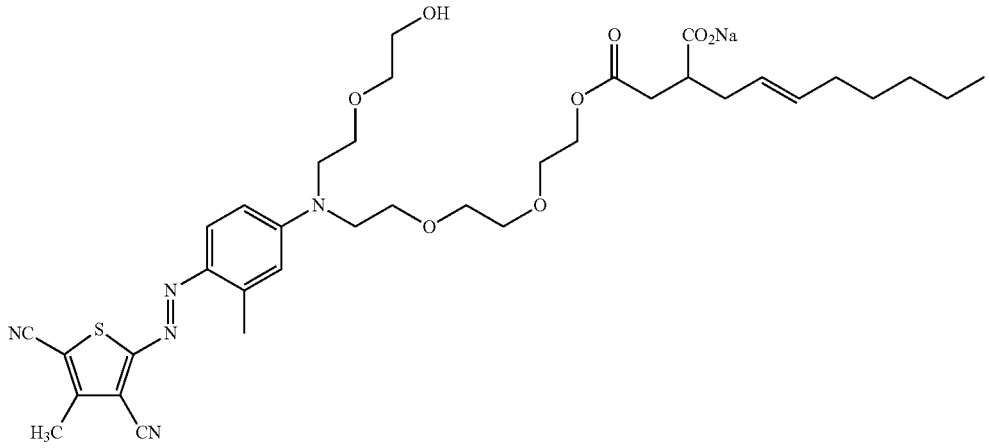

Dye Formula 10

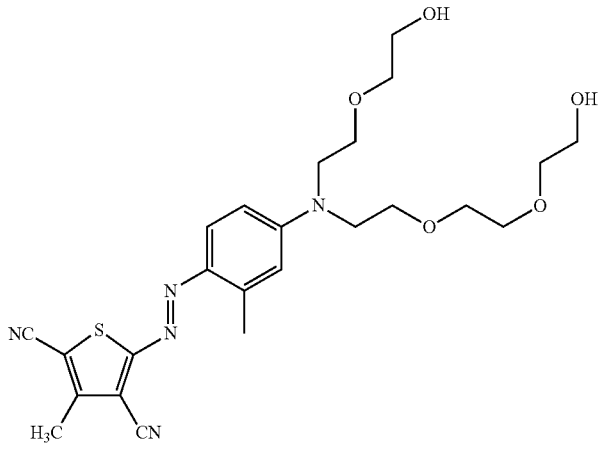

Dye-Clay Conjugates

Suitable dye clay conjugates include dye clay conjugates selected from the group comprising at least one cationic/basic dye and a smectite clay; a preferred clay may be selected from the group consisting of Montmorillonite clay, Hectorite clay, Saponite clay and mixtures thereof. In another aspect, suitable dye clay conjugates include dye clay conjugates selected from the group consisting of a clay and one cationic/basic dye selected from the group consisting of C.I. Basic Yellow 1 through 108, C.I. Basic Orange 1 through 69, C.I. Basic Red 1 through 118, C.I. Basic Violet 1 through 51, C.I. Basic Blue 1 through 164, C.I. Basic Green 1 through 14, C.I. Basic Brown 1 through 23, CI Basic Black 1 through 11 In still another aspect, suitable dye clay conjugates include dye clay conjugates selected from the group consisting of: Montmorillonite Basic Blue B7 C.I. 42595 conjugate, Montmorillonite Basic Blue B9 C.I. 52015 conjugate, Montmorillonite Basic Violet V3 C.I. 42555 conjugate, Montmorillonite Basic Green G1 C.I. 42040 conjugate, Montmorillonite Basic Red R1 C.I. 45160 conjugate, Montmorillonite C.I. Basic Black 2 conjugate, Hectorite Basic Blue B7 C.I. 42595 conjugate, Hectorite Basic Blue B9 C.I. 52015 conjugate, Hectorite Basic Violet V3 C.I. 42555 conjugate, Hectorite Basic Green G1 C.I. 42040 conjugate, Hectorite Basic Red R1 C.I. 45160 conjugate, Hectorite C.I. Basic Black 2 conjugate, Saponite Basic Blue B7 C.I. 42595 conjugate, Saponite Basic Blue B9 C.I. 52015 conjugate, Saponite Basic Violet V3 C.I. 42555 conjugate, Saponite Basic Green G1 C.I. 42040 conjugate, Saponite Basic Red R1 C.I. 45160 conjugate, Saponite C.I. Basic Black 2 conjugate and mixtures thereof.

The detergent composition of the present disclosure comprises water-soluble film which comprises the shading dye, meaning that the shading dye may be an integral part of the film and/or in contact with an exterior surface of the film. The shading dye may be added to the film-forming polymeric material prior to forming the film, for example prior to extruding or casting the film. The shading dye may be on an exterior surface of the water-soluble film, where an interior surface is in contact with the first composition. The shading dye may be applied to the exterior surface of the film by any suitable means. For example, the shading dye may be applied to the exterior of the film by dusting, powdering, coating, painting, printing, spraying, atomizing, or mixtures thereof. In some aspects, the shading dye is applied to the unit dose composition by spraying or atomizing a composition comprising the shading dye and a plasticizing solvent, which is described below. When the shading dye is sprayed or atomized onto a film, the sprayed or atomized composition may be non-aqueous, meaning that it comprises less than 20%, or less than 15%, or less than 10%, or less than 5%, or less than 1% water by weight of the sprayed or atomized composition. The sprayed or atomized composition may even comprise zero percent water.

The detergent composition may comprise a coating, where the coating comprises the shading dye.

In some aspects, the concentration of the shading dye on the surface of the film is from about 10 ppb to about 10,000 ppm, or preferably from about 50 ppb to about 200 ppm, or more preferably from about 10 ppm to about 250 ppm. In some aspects, the concentration of the shading dye is determined after storage of the unit dose article for one month at 25° C. and 60% relative humidity.

In one preferred embodiment, the shading dye is encapsulated separately or isolated from other components in the water-soluble film, for example, via capsules or microcapsules. It will be understood that when present in a capsules or microcapsule, the shading dyes color can be blocked or otherwise distorted.

Detergent Adjuncts

The detergent composition may comprise other suitable adjuncts which, in some aspects, can be wholly or partially incorporated into the film. Adjuncts may be selected according to the detergent composition's intended function. The first composition may comprise an adjunct. In some aspects, in the case of multi-compartment unit dose articles, the adjuncts may be part of a non-first (e.g., second, third, fourth, etc.) composition encapsulated in compartments separate from the first composition. The non-first composition may be any suitable composition. The non-first composition may be in the form of a solid, a liquid, a dispersion, a gel, a paste or a mixture thereof. Where the unit dose comprises multiple compartments, the shading dye may be added to or present in one, two, or even all the compartments.

Non-limiting examples of detergent compositions include cleaning compositions, fabric care compositions and hard surface cleaners. More particularly, the compositions may be a laundry, fabric care or dish washing composition including, pre-treatment or soaking compositions and other rinse additive compositions. The composition may be a fabric detergent composition or an automatic dish washing composition. The fabric detergent composition may be used during the main wash process or could be used as pre-treatment or soaking compositions.

Fabric care compositions include fabric detergents, fabric softeners, 2-in-1 detergent and softening, pre-treatment compositions and the like. Fabric care compositions may comprise typical fabric care adjuncts, including surfactants, builders, chelating agents, dye transfer inhibiting agents, dispersants, enzymes, and enzyme stabilizers, plasticizing solvents, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments and mixtures thereof. The composition may be a laundry detergent composition comprising an adjunct selected from the group comprising a surfactant, polymers, perfumes, encapsulated perfume materials, structurant and mixtures thereof.

The composition may be an automatic dish washing composition comprising an adjunct selected from surfactant, builder, sulfonated/carboxylated polymer, silicone suds suppressor, silicate, metal and/or glass care agent, enzyme, bleach, bleach activator, bleach catalyst, source of alkalinity, perfume, dye, solvent, filler and mixtures thereof.

Preferably, the liquid composition comprises a surfactant. Surfactants can be selected from anionic, cationic, zwitterionic, non-ionic, amphoteric or mixtures thereof. Preferably, the unit dose composition comprises anionic surfactant, non-ionic surfactant, or mixtures thereof. The detergent composition, preferably the liquid composition, may comprise from about 1% to about 70%, or from about 3% to about 50%, or from about 5% to about 25%, by weight of a surfactant system.

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$-$C_{16}$ alkyl group, m is from 2 to 4, and n ranges from about 2 to 12. In one aspect, $R^1$ is an alkyl group, which may be primary or secondary, that comprises from about 9 to 15 carbon atoms, or from about 10 to 14 carbon atoms. In one aspect, the alkoxylated fatty alcohols will also be ethoxylated materials that contain from about 2 to 12 ethylene oxide moieties per molecule, or from about 3 to 10 ethylene oxide moieties per molecule.

The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

The compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the cleaning composition.

The composition may comprise a brightener. Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein. Suitable chelants include a chelant selected from the group consisting of DTPA (Diethylene triamine pentaacetic acid), HEDP (Hydroxyethane diphosphonic acid), DTPMP (Diethylene triamine penta(methylene phosphonic acid)), ethylenediaminedisuccinic acid (EDDS), 1,2-Dihydroxybenzene-3,5-disulfonic acid disodium salt hydrate, and derivatives of such chelants.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The compositions of the present disclosure may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

The composition may comprise one or more polymers. Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Suitable suds suppressors include silicone and/or fatty acid such as stearic acid.

When the detergent composition comprises a liquid composition encapsulated by the water-soluble film, the liquid composition preferably comprises a plasticizing solvent. The liquid composition may comprise from about 10% to about 50%, or from about 15% to about 40%, by weight of the liquid composition, of the plasticizing solvent.

The plasticizing solvent in the present compositions can be a plasticizing solvent containing water, organic solvent, or mixtures thereof. Suitable organic solvents include low molecular weight alcohols and/or low molecular weight glycols, wherein "low molecular weight" in this context means having a molecular weight of less than about 500. Suitable organic solvents preferably include glycerol, 1,2-propanediol, 1,3-propanediol, dipropylene glycol, diethylene glycol, sorbitol, and mixtures thereof. In some aspects, the plasticizing solvent comprises water, glycerol, 1,2-propanediol, 1-3-propanediol, dipropylene glycol, diethylene glycol, sorbitol, or mixtures thereof.

Process for Washing

The present disclosure also relates to a process for the washing, for example by machine, of laundry or dishware using a composition according to the present disclosure, comprising the steps of, placing a detergent composition according to the present disclosure into contact with the laundry or dishware to be washed, and carrying out a washing or cleaning operation.

Any suitable washing machine may be used. Those skilled in the art will recognize suitable machines for the relevant wash operation. The article of the present invention may be used in combination with other compositions, such as fabric additives, fabric softeners, rinse aids, and the like.

Additionally, the detergent compositions of the present disclosure may be used in known hand washing methods.

Process for Making

The present disclosure relates to a method of making a detergent composition. More specifically, the present disclosure relates to a method of making a detergent composition comprising a first composition, a water-soluble film and a shading dye, where the method comprises the step of incorporating the shading dye into the water-soluble film. The incorporating step may be according to any suitable method of making a detergent composition known to one of ordinary skill, for example by spraying, atomizing, or mixtures thereof said shading dye into said film. In such embodiments, the shading dye may be added to the film composition prior to casting or extrusion of the film Where the first composition is a granular detergent or a tablet detergent, the method comprises the step of encasing the first composition in either a water-soluble film or a water-soluble coating. Alternatively, the method may comprise the step of providing the first composition already encased in either a water-soluble film or a water-soluble coating.

In some aspects, the present disclosure relates to making a film comprising a shading dye, wherein the method comprises the steps of providing a liquid composition comprising a shading dye and a plasticizing solvent, and contacting a water-soluble film with the liquid composition, wherein the film comprises a plasticizing agent. The film may be formed into a pouch and sealed, thereby forming a sealed pouch. In some aspects, the sealed pouch encapsulates surfactant. In some aspects, the contacting results from filling the pouch with the liquid composition. In some aspects, the contacting results from spraying or atomizing said liquid composition onto said film. The film may be formed into a pouch after the spraying or atomizing.

The method of making unit dose articles is described in more detail below.

The process of the present disclosure may be continuous or intermittent. The process comprises the general steps of forming an open pouch, preferably by forming a water-soluble film, which may comprise a shading dye, into a mould to form said open pouch, filling the open pouch with a composition, closing the open pouch filled with a composition, preferably using a second water-soluble film, which may comprise a shading dye, to form the unit dose article. The second film may also comprise additional compartments, which may or may not comprise compositions. Alternatively, the second film may be a second closed pouch containing one or more compartments, used to close the open pouch. Preferably, the process is one in which a web of unit dose article are made, said web is then cut to form individual unit dose articles.

Alternatively, the first film may be formed into an open pouch comprising more than one compartment. In which case, the compartments formed from the first pouch may be in a side-by-side or 'tire and rim' orientation. The second film may also comprise compartments, which may or may not comprise compositions. Alternatively, the second film may be a second closed pouch used to close the multicompartment open pouch.

The unit dose article may be made by thermoforming, vacuum-forming or a combination thereof. Unit dose articles may be sealed using any sealing method known in the art. Suitable sealing methods may include heat sealing, solvent sealing, pressure sealing, ultrasonic sealing, pressure sealing, laser sealing or a combination thereof. Examples of continuous in-line processes of manufacturing water-soluble containers are set forth in U.S. Pat. No. 7,125,828, U.S. 2009/0199877A1, EP 2380965, EP 2380966, U.S. Pat. No. 7,127,874 and US2007/0241022 (all to Procter & Gamble Company, Ohio, USA). Examples of non-continuous in-line processes of manufacturing water-soluble containers are set forth in U.S. Pat. No. 7,797,912 (to Reckitt Benckiser, Berkshire, GB).

The unit dose articles may be dusted with a dusting agent. Dusting agents can include talc, silica, zeolite, carbonate or mixtures thereof.

An exemplary means of making the unit dose article of the present disclosure is a continuous process for making an article, comprising the steps of:

a. continuously feeding a first water-soluble film, which may comprise a shading dye, onto a horizontal portion of an continuously and rotatably moving endless surface, which comprises a plurality of moulds, or onto a non-horizontal portion thereof and continuously moving the film to said horizontal portion;
b. forming from the film on the horizontal portion of the continuously moving surface, and in the moulds on the surface, a continuously moving, horizontally positioned web of open pouches;
c. filling the continuously moving, horizontally positioned web of open pouches with a product, to obtain a horizontally positioned web of open, filled pouches;
d. preferably continuously, closing the web of open pouches, to obtain closed pouches, preferably by feeding a second water-soluble film, which may comprise a shading dye, onto the horizontally positioned web of open, filed pouches, to obtain closed pouches; and
e. optionally sealing the closed pouches to obtain a web of closed pouches.

The second water-soluble film may comprise at least one open or closed compartment.

In one embodiment, a first web of open pouches is combined with a second web of closed pouches preferably wherein the first and second webs are brought together and sealed together via a suitable means, and preferably wherein the second web is a rotating drum set-up. In such a set-up, pouches are filled at the top of the drum and preferably sealed afterwards with a layer of film, the closed pouches come down to meet the first web of pouches, preferably open pouches, formed preferably on a horizontal forming surface. It has been found especially suitable to place the rotating drum unit above the horizontal forming surface unit.

Preferably, the resultant web of closed pouches is cut to produce individual unit dose articles.

EXAMPLES

Formulation Examples

All levels are in weight percent of the composition.

Example 1—Mono Compartment Pouches

Mono compartment pouches are filled with liquid detergents of composition 1.1, shown in Table 1. The pouches are made using M8779 film, available from Monosol, and formed using standard thermoforming techniques. Specifically, 0.7 g of a 76 μm thick film M8779 and 0.0025 g of Dye Formula 8, shown above, are thermoformed to form a single compartment pouch measuring 41 mm by 43 mm. The pouch is filled with 23.7 mL (25.4 g) of composition 1.1.

TABLE 1

| Ingredients | Composition 1.1 |
|---|---|
| Linear $C_9$-$C_{15}$ Alkylbenzene sulfonic acid | 20 |
| $C_{12-14}$ alkyl 9-ethoxylate | 15 |
| Citric Acid | 1 |
| Fatty acid | 8 |
| C12-14 alkyl ethoxy 3 sulfate | 9 |
| Chelant | 1 |
| Polymer | 7 |
| Enzymes | 1 |
| Structurant | 0.15 |
| Glycerol | 6 |
| 1,2 propanediol | 11 |
| Water | 10 |
| Mono-ethanolamine or NaOH (or mixture thereof) | neutralize to pH to about 7.4 |
| Additives, Minor | To 100% |

Example 2—Multi Compartment Pouches

Examples of multicompartment pouches can include the formulations presented in Table 2. The pouches are made with water-soluble film, according to those disclosed in US Patent Application 2011/0188784A1.

TABLE 2

| | 2.1 3 compartments | | | 2.2 2 compartments | | 2.3 3 compartments | | |
|---|---|---|---|---|---|---|---|---|
| Compartment # | 1 | 2 | 3 | 1 | 2 | 1 | 2 | 3 |
| Dosage (g) | 34.0 | 3.5 | 3.5 | 30.0 | 5.0 | 25.0 | 1.5 | 4.0 |
| Ingredients | | | | Weight % | | | | |
| Alkylbenzene sulfonic acid | 20.0 | 20.0 | 20.0 | 10.0 | 20.0 | 20.0 | | |
| Alkyl sulfate | | | | 2.0 | | | | |
| C12-14 alkyl 7-ethoxylate | 17.0 | 17.0 | 17.0 | | 17.0 | 17.0 | | |
| Cationic surfactant | | | | 1.0 | | | | |
| Zeolite A | | | | 10.0 | | | | |
| C12-18 Fatty acid | 13.0 | 13.0 | 13.0 | | 18.0 | 18.0 | | |
| Sodium acetate | | | | 4.0 | | | | |
| Enzymes | 0-3 | 0-3 | 0-3 | 0-3 | | 0-3 | | |
| Sodium Percarbonate | | | | 11.0 | | | | |
| TAED | | | | 4.0 | | | | |
| Organic catalyst [1] | | | | 1.0 | | | | |
| PAP granule [2] | | | | | | | | 50 |
| Polycarboxylate | | | | 1.0 | | | | |
| Ethoxysulfated Hexamethylene Diamine Dimethyl Quat | 2.2 | 2.2 | 2.2 | | | | | |
| Hydroxyethane diphosphonic acid | 0.6 | 0.6 | 0.6 | 0.5 | | | | |
| Ethylene diamine tetra(methylene phosphonic) acid | | | | | | 0.4 | | |
| Brightener | 0.2 | 0.2 | 0.2 | 0.3 | | 0.3 | | |
| Alkoxylated polyamine[6] | 5 | | | | 4 | 7 | | |
| Hueing dye [4] | | | 0.05 | | 0.035 | | 0.12 | |
| Perfume | 1.7 | 1.7 | | 0.6 | | 1.5 | | |
| Water | 10.0 | 10.0 | 10.0 | | 4.0 | | | |
| Glycerol | 5 | | | | | 6 | 10 | |
| Sorbitol | | | | | 1 | | | |
| Propane diol | 5 | 5 | 5 | | 30 | 11 | 89 | |
| Buffers (sodium carbonate, monoethanolamine) [5] | | | | To pH 8.0 for liquids<br>To RA >5.0 for powders | | | | |
| Minors (antioxidant, aesthetics, . . . ), sodium sulfate for powders | | | | To 100% | | | | |

[1] Sulfuric acid mono-[2-(3,4-dihydro-isoquinolin-2-yl)-1-(2-ethyl-hexyloxymethyl)-ethyl]ester as described in U.S. Pat. No. 7,169,744

[2] PAP = Phthaloyl-Amino-Peroxycaproic acid, as a 70% active wet cake

[3] Polyethylenimine (molecular weight = 600) with 20 ethoxylate groups per —NH.

[4] Ethoxylated thiophene of Formula A, shown above, EO (x + y) = 5; At least 10%, preferably at least 50% of the dye present is incorporated in at least one of the multiple films that comprise the article.

[5] RA = Reserve Alkalinity (g NaOH/dose)

[6] PEI600 EO20, available from BASF

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A unit dose article comprising:

a. a first composition b. at least two compartments comprising water-soluble films, wherein one compartment encapsulates the first composition; and c. a shading dye wherein said first composition is selected from the group consisting of a liquid detergent, a granular detergent, or a tablet detergent, wherein the shading dye has the following structure:

$$\text{Dye-(G)a-NR}^1\text{R}^2,$$

wherein the -(G)a-$NR^1R^2$ group is attached to an aromatic ring of the dye, G is independently —$SO_2$— or —C(O)—, the index a is an integer with a value of 0 or 1, and $R^1$ and $R^2$ are independently selected from the group consisting of H, a polyoxyalkylene chain, $C_{1-8}$alkyl, $C_{6-10}$ aryl, $C_{7-16}$ alkaryl, polyoxyalkylene chain substituted $C_{1-8}$alkyl, polyoxyalkylene chain substituted $C_{6-10}$ aryl, polyoxyalkylene chain substituted $C_{7-16}$ alkaryl and mixtures thereof; said polyoxyalkylene chains independently having from about 2 to about 100 repeating units, wherein the water-soluble films comprise a first film, a second film and a common wall, wherein the common wall is shared by the at least two compartments, wherein substantially all of the shading dye is incorporated into the common wall of the unit dose article and the first film and second film are free of the shading dye, wherein the shading dye is added to the common wall prior to casting or extrusion of the common wall, and wherein the shading dye forms an integral part of the common wall.

2. A unit dose article according to claim 1, wherein the shading dye is selected from the group consisting of acridines, anthraquinones, azines, azos, benzodifuranes, benzodifuranones, carotenoids, coumarins, cyanines, diazahemicyanines, diphenylmethanes, formazans, hemicyanines, indigoids, naphthalimides, naphthoquinones, nitros, nitrosos, oxazines, phthalocyanines, pyrazoles, stilbenes, styryls, triarylmethanes, triphenylmethanes, xanthenes and mixtures thereof.

3. A unit dose article according to claim 1, wherein the shading dye is selected from the group consisting of an anthraquinone dye, an azine dye, an azo dye, a polymeric anthraquinone dye, a polymeric azine dye, a polymeric azo dye, and mixtures thereof.

4. A unit dose article according to claim 1, wherein the shading dye is a polymeric dye and at least one of $R^1$ and $R^2$ comprises a polyoxyalkylene chain.

5. A unit dose article according to claim 4, wherein the polyoxyalkylene chain comprises from about 2 to about 50 repeating units, wherein the repeating units are essentially ethylene oxide.

6. A unit dose article according to claim 1, wherein the first composition is a liquid detergent.

7. A unit dose article according to claim 1, wherein the first composition comprises less than 50% water.

8. A unit dose article according to claim 1, wherein said first composition comprises an adjunct selected from the group consisting of surfactants, builders, chelating agents, dye transfer inhibiting agents, dispersants, enzymes, enzyme stabilizers, catalytic materials, bleach activators, polymeric dispersing agents, clay soil removal agents, anti-redeposition agents, brighteners, suds suppressors, dyes, perfume, perfume delivery systems, structure elasticizing agents, fabric softeners, carriers, hydrotropes, processing aids, pigments and mixtures thereof.

* * * * *